United States Patent [19]

Richards et al.

[11] Patent Number: 4,604,075

[45] Date of Patent: Aug. 5, 1986

[54] TOY HELICOPTER WITH A CONTROL UNIT

[75] Inventors: Lawrence D. Richards, Huntington Station, N.Y.; Johnny S. C. Yuen, West Point, Hong Kong

[73] Assignee: Arco Industries, Harbour City, Hong Kong

[21] Appl. No.: 736,954

[22] Filed: May 22, 1985

[51] Int. Cl.[4] ..... A63H 27/00

[52] U.S. Cl. ..... 446/232; 446/454

[58] Field of Search ..... 446/232, 231, 230, 36, 446/37, 454, 455, 456, 462

[56] References Cited

U.S. PATENT DOCUMENTS

| | | | |
|---|---|---|---|
| 2,860,447 | 11/1958 | Muller et al. | 446/232 |
| 3,402,505 | 9/1968 | Nakamura | 446/454 |
| 4,073,086 | 2/1978 | Ogawa | 446/232 X |

FOREIGN PATENT DOCUMENTS

| | | | |
|---|---|---|---|
| 1303241 | 1/1973 | United Kingdom | 446/462 |

*Primary Examiner*—Mickey Yu

*Attorney, Agent, or Firm*—Lilling & Greenspan

[57] ABSTRACT

Toy helicopter with a control unit which can be removed from the body of the helicopter and placed in one of several positions. The helicopter has a rotor blade which is powered by a motor connected to it via compound gears and a rotary driving shaft. The motor is controlled by a removable control unit which is inserted into the helicopter body and which has an activating switch. When the activating switch is pushed, the switch contact is moved into position to complete the circuit with the battery contact and the resulting electricity from the battery travels to the motor.

The control unit is a self-contained unit which is connected to the driving mechanism of the helicopter by a wire cord which may be stored in the helicopter's body. The unit can be positioned into the helicopter body in one of three positions including a horizontal position so that the toy can be operated on level surfaces, or a vertical position so that the helicopter can be operated while being hand-held, or it may be completely removed from the helicopter body to operate the toy at a distance.

4 Claims, 6 Drawing Figures

TOY HELICOPTER WITH A CONTROL UNIT

BACKGROUND OF THE INVENTION

Although motorized toy vehicles have been long time playing favorites of children for many years, many of these toys have been limited by a design including only one operational control means which could not be moved from one position in the toy's body to another. In this invention a toy helicopter is operated by a self-contained control unit which is completely removable from the helicopter body and which can be positioned horizontally into the body to be operated along a level surface, or positioned vertically in the body to be hand held by an operator or can be operated remotely from the helicopter.

Motorized toy helicopters have traditionally been manufactured with a built-in control means which would shuttle the helicopter along a level surface or with a remote control which would allow the operator to control the toy at a distance.

A problem with these motorized toys is, however, that a toy manufactured wth a remote control unit could only be operated remotely by the child. Likewise, a toy manufactured with a control unit in the toy could not be operated remotely or at a distance. None of the manufactured toys combined the several different ways of operating the toy as does the present invention, allowing a child diversity in his playing.

Further, since the control unit is manufactured as a single piece, it is easy to remove and insert into the helicopter body, as well as being durable in the hands of young children. Thus, the object of this invention is to provide a toy helicopter which has a versatile means of control and which can be operated independently of a child along a level surface, or can be hand held, or can be operated remotely by a single simple control unit.

SUMMARY OF THE INVENTION

The present invention consists of a toy helicopter whose body houses a motorized means for rotating a rotor blade which is operated by a self-contained control unit. The control unit is connected to the motorized means by a wire cord which can be stored in the helicopter body and permits the complete removal of the control unit from the helicopter body so it may be placed in one of three positions.

When placed horizontally into the helicopter body, the control unit can activate the helicopter to cause it to travel along level surfaces independently of the operator. In a second or vertical position in the helicopter body, the operator can control the motorized rotor blade while holding the toy in his hand. Finally, the control unit can be completely removed from the helicopter body and operated at a distance. Thus, a toy helicopter which is simple in construction and has the unique feature of being operated in several different positions is produced which appeals to the versatile playing needs of children.

DETAILED DESCRIPTION OF THE INVENTION

Figure 1:
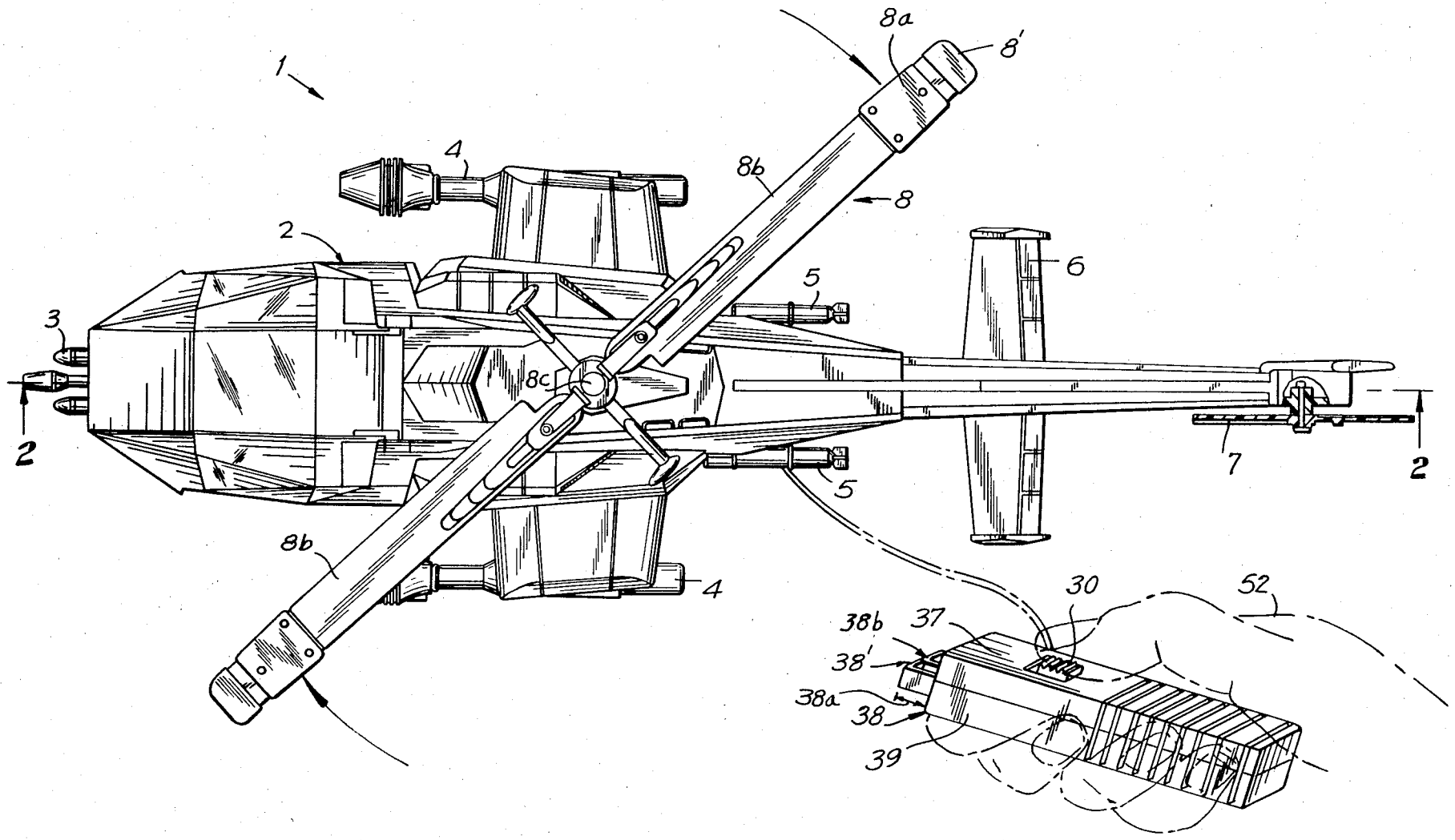
FIG. 1 is a top view of the toy helicopter showing the control unit in a remote position from the toy.
Figures 2, 3, 4, 5, 6:
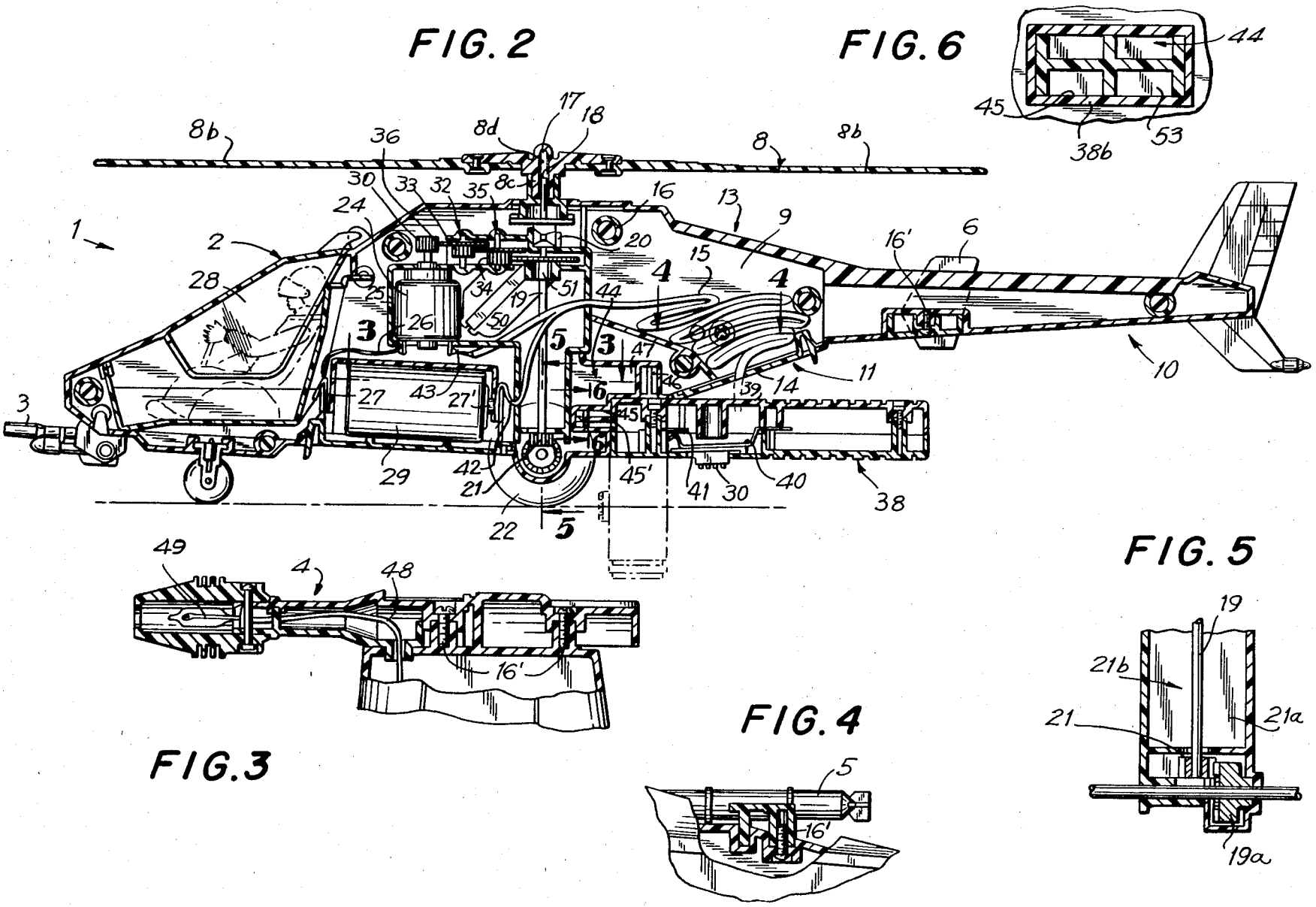
FIG. 2 is a cross-sectional view taken along lines 2—2 of FIG. 1.
FIG. 3 is a cross-sectional view of the left machine rifle taken along lines 3—3 of FIG. 2.
FIG. 4 is a cross-sectional view illustrating a propeller fastening means taken along lines 4—4 of FIG. 2.
FIG. 5 is a cross-sectional view of a driving wheel taken along the lines 5—5 of FIG. 2.
FIG. 6 is a cross-sectional view of the finger of the control unit taken along lines 6—6 of FIG. 2.

The body design 2 of the toy helicopter 1 is illustrated in top view in FIG. 1 and in a cross-sectional view in FIG. 2. In FIG. 2, the toy helicopter 1 is designed as a military helicopter including a front machine gun 3, a side machine rifle 4 and side missiles 5. Further, a tail wing 6 and a tail propeller 7 have been added onto the body 2; if desired, the body 2 may be designed in any other style desired to further imitate a military or civilian helicopter.

Additionally, the helicopter body 2 may be made of any suitable material known in the art, including a plastic or a metal material. Preferably, a durable plastic material is used to make the body 2 to facilitate molding of its parts and to produce a durable toy. Further, the rotor blade 8 is preferably molded from a soft plastic material in order to avoid safety hazards to children who stick their fingers near the rotating blade 8.

The helicopter body 2 preferably contains a storage compartment 9 near the tail end 10 of the body 2 which opens through a bottom side 11 of the body 2 and is covered by a compartment cover 14. The storage compartment 9 serves as a storage area for a cord wire 15, when its full length is not needed.

The machine gun 3, machine rifle 4, missiles 5, and tail wing 6 are connected to the helicopter body 2 by any conventional fastener 16 known in the art. FIGS. 3 and 4 illustrate that the machine rifle 4 and the missile 5 have been attached in the preferred embodiment via a screw 16'. A screw 16' is also used to connect the tail wing 6 to the body 2, as well as the tail propeller 7 to the body 2, as illustrated in FIG. 2.

The helicopter 1 has a motorized rotor blade 8 which consists of two blade sections **8*b* fastened to a central axle 8*c* having a cavity 8*d* opening through its bottom side. The central axle cavity 8*d* fits sungly onto a rotor head 17 to position the rotor blade 8 near the top 13 of the helicopter 1. The rotor head 17 is the top portion 18 of a driving shaft 19 which extends through the length of the helicopter body 2. In a preferred embodiment, a soft plastic coating 8*a* is placed over the rotor blade tips 8' to prevent an accidental injury to a child who sticks his hands or face near the rotor blade 8** as it is turning.

In the preferred embodiment, the driving shaft 19 has a driving disc 20 near the top 18 of the helicopter 2 and a driving wheel 21 near the bottom 11 of the helicopter body 2 above a main undercarriage wheel 22. The driving wheel 21 is a conventional mechanism consisting of a right gear box **21*a* with a clutch 19*a* and a left gear box 21*b* as shown in cross section in FIG. 5**.

The rotor blade 8 is turned as the driving shaft 19 is rotated by means of a compound gear system 23, motor 24 and power supply 29 illustrated in a cross-sectional view in FIG. 2. The compound gear system 23 is connected to the motor 24 within a housing 25. The motor 24 is connected to the power supply 29 by means of a contact wire 26 connected to a power contact 27 of the power supply 29 behind the cockpit 28 and by means of the wire cord 15 connected to a power contact 27' of the power supply 29 above the undercarriage wheel 22 of the helicopter body 2.

Although any power supply source may be used, a conventional battery 29 well known in the art has been chosen for the preferred embodiment. Thus, when a switch mechanism 30 is activated an electrical circuit is completed and the battery 29 produces current which is transmitted to the motor 24 via the contact wire 26. The motor 24 generates additional energy which turns a first gear 31 which is mounted on a gear shaft 31*a*. As the first gear 31 rotates, it drives a second shaft 32 with a second gear wheel 33 which is rotated at a speed relative to its size as compared to the first gear 31. In sequence, the second gear 33 rotates a third gear 34 mounted on a third shaft 35 which in turn rotates the driving shaft 19 and subsequently turns the rotor blade 8. The gears 23 transmit rotary motion from one gear to another to the driving shaft 19 through meshing perimetral teeth 36 on the surface of the gear wheels. The arrangement of compound gears 23, motor 24 and battery 29 is illustrated in cross-section in FIG. 2.

The switch mechanism 30 which is activated to complete the electric circuit is mounted on one side 37 of a control unit 38. When the switch 30 is pushed to an "off" position, a switch lever 40 is disconnected from a battery contact 41 and the flow of current is interrupted. When the switch mechanism 30 is slid into an "on" position, the switch lever 40 is pushed upward to contact the battery contact 41 and to complete the electric circuit which runs through the cord wire 15 from the control unit 38 through the storage compartment 9. The wire cord 15 consists of two conductors, one conductor having an end 42 connected to the power contact 27' of the battery 29 and a second conductor having an end 43 connected to the motor 24.

With the circuit running through the cord wire 15, the switch 30 can be installed in a self contained control unit 38. This unit 38 may be placed in a number of positions into the helicopter body 2 in order to activate the switch 30 to complete the circuit.

Figure 7:
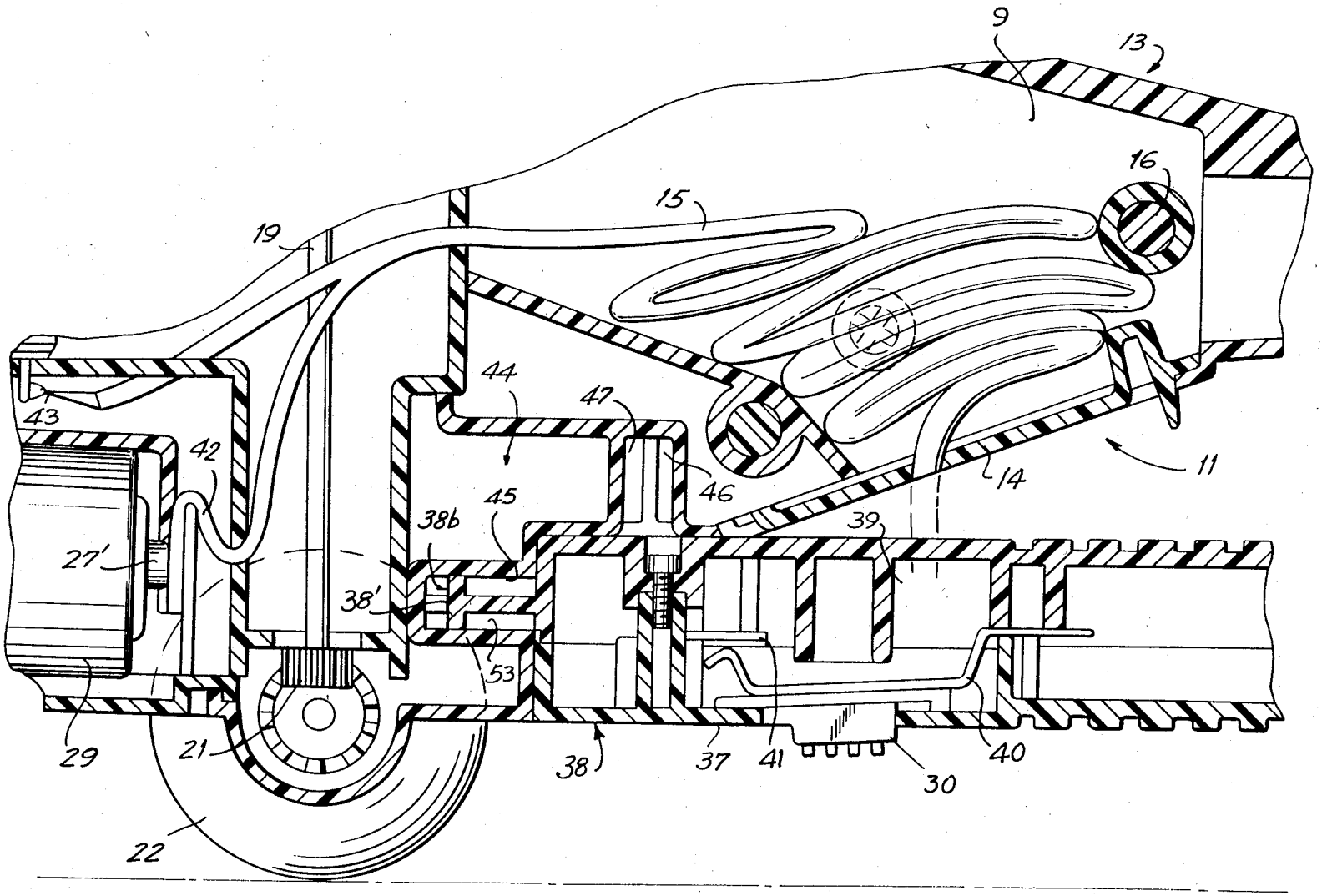

In one preferred position as illustrated in FIG. 7, the control unit 38 is inserted into a premolded area 44 of the helicopter body 2 which has a cutaway opening 45 facing the tail plane 6 in a horizontal position. Preferably, the cutaway opening 45 is in the shape of a rectangular box with the long sides of the front 38*b* of the rectangular box parallel to the plane in which the rotor blade 8 is located. Further, the depth of the opening is preferably $\frac{3}{8}$ of an inch, but may be of any depth dimension which may be accommodated in the premolded area 44 and which snugly holds the control unit 38 in position.

In the preferred embodiment, an extended finger 38' of the control unit 38, which is also shaped as a rectangular box with a depth of $\frac{3}{8}$ of an inch, can be inserted into the opening 45 by means of press fitting. It is possible to vary the depth of the opening 45 and the corresponding depth 38*a* of the finger 38' to any desired dimension.

To insert the control unit 38 horizontally into the helicopter body 2 one holds the unit 38 to position the side of the control unit 38 having the switch mechanism 30 downward in a direction away from the bottom 11 of the helicopter 1. The face side 38*b* of the finger 38', which is away from the control unit 38, is then aligned with the opening 45 and the finger 38' is inserted in a level horizontal plane until the entire finger 38' is inserted into the opening 45.

In this position, the control unit 38 is in a plane horizontal with that of the rotor blade 8 and the switch mechanism 30 is on the side 37 of the control unit 38 away from the helicopter body 2. Thus, the helicopter 1 can be turned on and the rotating rotor blade 8 will carry the toy across a level surface on its main carriage wheels 22 independently of the user.

A horizontal position is the preferred positioning of the control unit 38 in the opening 45 because it achieves the maximum height clearance possible from a level surface to the side of the control unit 38, which is nearly flush with the helicopter's undercarriage 11. Thus, slightly uneven obstacles along the surface will not scrap against the side 39 of the control unit 38 to interfere with the toy's forward movement. It may be appreciated, however, that the opening 45 can be molded as a trapezoid or any other slanting side shape which would accommodate a finger 38' of a similar shape to tilt the unit 38 in an upward or downward angle relative to a level surface. Limitations of the sizes and shapes of the opening 45 and finger 38' include the clearance from the level surface on one side 39 of the unit 38 and the clearance of a second side 37 of the unit 38 from the bottom 11 of the helicopter 1 beneath the storage area 9. It is possible to redesign the helicopter body 2 to decrease the depth of the storage compartment 9 to accommodate a unit 38 which is inserted at a larger angle into the helicopter body 2.

The rectangular shape of the finger 38' is shown in one embodiment in cross-section in FIG. 6. In the illustrated design the finger has channels 53 running parallel in the direction of the sides 37, 39 of the control unit 38. However, as discussed above, the finger 38' can be molded in any preferred shape to be inserted into a matching opening.

In a second position the finger 38' of the control unit 38 fits snugly into a second cutaway opening 46 in a premolded area 47 in the bottom side 11 of the helicopter body 2 so that the control unit 38 is in a perpendicular plane to that of the rotor blade 8. In this position, the switch mechanism 30 is on the side of the control unit 38 closest to the cockpit 28 of the toy 1, and an operator 52 can automatically rotate the rotor blade 8 while holding the toy 1 by the control unit 38.

As discussed for the first position above, the finger 38' of the unit 38 and the opening into which it is inserted may be varied in shape and size. Although it is preferably to hold the unit when inserted into the helicopter in a plane perpendicular to that of the rotor blade 8 to enable the operator to hold the toy horizontally in relation to a ground surface, the unit 38 may be inserted into the helicopter 1 at any angle to a ground surface which is desired. The limitations of the design of the cutaway and finger shape include the clearance of the unit 38 from the main undercarriage wheels 22 and from the storage compartment 9. Further, the switch mechanism 30 may be reversably placed on a second side 39 of the control unit 38 allowing the unit 38 to be inserted into the body 2 at an angle closer to the undercarriage wheels 22.

In a third position, the self-contained control unit 38 can be completely removed from the helicopter body 2 and the switch mechanism 30 can be activated causing the rotor blade 8 to rotate at a distance from the operator 52. In this position, the storage compartment cover 14 may be removed to release the wire cord 15 to a desired length from the operator 52 to the toy helicopter 1.

Further, in the preferred embodiment, the machine rifle 4 contains a contact wire 48 which is connected to the electric circuit and which is used to turn the machine rifle light filament 49 on and off by a means well known in the trade. A cross sectional view of the machine rifle 4 is shown in FIG. 3.

A sound strip 50 is attached in the helicopter body 2 near the driving shaft 19 of the rotor blade 8 so that when the driving shaft 19 is rotated a turning strip 51 mounted on the driving shaft 19 rotates past the second strip 50 to strike it and make a sound effect similar to that of a rotating helicopter rotor blade.

I claim:

1. A toy helicopter which comprises:

(a) a housing;

(b) a rotor blade attached to a top portion of a driving shaft which extends vertically through said housing;

(c) a motorized means for rotating said rotor blade connected to said driving shaft;

(d) a self-contained control unit removably insertable into said housing and having a switch mechanism connected to a first conductor end of a wire cord, and a second conductor end of said wire cord being connected to said motorized means, said control unit when inserted in said housing having a first position whereby said control unit is in a plane parallel to a plane of said rotor blade and said control unit activates an electrical circuit of said motorized means causing the toy helicopter to travel along a horizontal surface, and a second position whereby said control unit is in a plane perpendicular to said plane of said rotor blade and activates said electrical circuit permitting control of the toy helicopter by hand, and said control unit takes a third position when removed from said housing whereby said control unit is remote from the toy helicopter.

2. A toy helicopter according to claim 1, wherein said motorized means comprises a power supply, a motor and a compound gear system connected to said driving shaft and rotating the rotor blade.

3. A toy helicopter according to claim 1, wherein said helicopter further comprises a sound strip connected to said motorized means and creating a sound effect when said rotor blade is rotated.

4. A toy helicopter according to claim 1, wherein said rotor blade is made of a pliable plastic material.

* * * * *